US008066795B2

(12) United States Patent
Mizuno et al.

(10) Patent No.: US 8,066,795 B2
(45) Date of Patent: Nov. 29, 2011

(54) THERMAL SPRAY POWDER AND THERMAL SPRAY COATING

(75) Inventors: Hiroaki Mizuno, Kakamigahara (JP); Junya Kitamura, Kakamigahara (JP)

(73) Assignee: Fujimi Incorporated, Kiyosu-shi (JP)

( * ) Notice: Subject to any disclaimer, the term of this patent is extended or adjusted under 35 U.S.C. 154(b) by 1039 days.

(21) Appl. No.: 11/854,284

(22) Filed: Sep. 12, 2007

(65) Prior Publication Data

US 2008/0245185 A1 Oct. 9, 2008

(30) Foreign Application Priority Data

Sep. 12, 2006 (JP) ..... 2006-247197

(51) Int. Cl.
*B22F 1/00* (2006.01)
*C23C 4/04* (2006.01)

(52) U.S. Cl. ..... 75/252; 427/451

(58) Field of Classification Search ..... 75/240, 75/252; 427/451
See application file for complete search history.

(56) References Cited

U.S. PATENT DOCUMENTS

| | | | | |
|---|---|---|---|---|
| 4,865,252 | A | 9/1989 | Rotolico et al. | |
| 4,925,626 | A | 5/1990 | Anand et al. | |
| 4,989,306 | A * | 2/1991 | Leino et al. | 492/59 |
| 5,075,129 | A | 12/1991 | Jackson et al. | |
| 5,419,976 | A | 5/1995 | Dulin | |
| 5,580,833 | A | 12/1996 | Fu et al. | |
| 5,669,988 | A * | 9/1997 | Takenaka et al. | 148/210 |
| 5,747,163 | A | 5/1998 | Douglas | |
| 5,763,106 | A | 6/1998 | Blanchard et al. | |
| 5,789,077 | A | 8/1998 | Nakahama et al. | |
| 5,928,976 | A | 7/1999 | Yamamoto et al. | |
| 6,004,372 | A | 12/1999 | Quets | |
| 6,254,704 | B1 | 7/2001 | Laul et al. | |
| 6,290,633 | B1 * | 9/2001 | Sondergeld | 492/58 |
| 6,482,534 | B2 | 11/2002 | Itsukaichi et al. | |
| 6,641,917 | B2 | 11/2003 | Itsukaichi et al. | |
| 2006/0053967 | A1 * | 3/2006 | Mizuno et al. | 75/240 |
| 2006/0116274 | A1 * | 6/2006 | Kitamura et al. | 501/152 |
| 2006/0134343 | A1 * | 6/2006 | Kato et al. | 427/446 |
| 2010/0221543 | A1 * | 9/2010 | Sudoh et al. | 428/402 |
| 2011/0021801 | A1 * | 1/2011 | Wehmeier et al. | 556/466 |

FOREIGN PATENT DOCUMENTS

| | | | |
|---|---|---|---|
| CN | 1081721 | A | 2/1994 |
| CN | 1487110 | A | 4/2004 |
| JP | 08-060596 | | 3/1996 |
| JP | 2003-129212 | | 5/2003 |
| JP | 2004-169080 | * | 6/2004 |
| JP | 2006-029452 | | 2/2006 |

* cited by examiner

*Primary Examiner* — Roy King
*Assistant Examiner* — Ngoclan Mai
(74) *Attorney, Agent, or Firm* — Vidas, Arrett & Steinkraus, P.A.

(57) ABSTRACT

A thermal spray powder including cermet particles, each of which contains metal containing at least one selected from the group consisting of cobalt, chrome, and nickel, and tungsten carbide. The ratio of the summed weight of cermet particles having a particle size of 25 μm or more in the thermal spray powder with respect to the summed weight of the entire cermet particles in the thermal spray powder is 0.5 to 15%. A thermal spray coating formed from the thermal spray powder is suitable for the formation of a tungsten carbide-based cermet thermal spray coating for use in rolls such as corrugated rolls.

13 Claims, No Drawings

THERMAL SPRAY POWDER AND THERMAL SPRAY COATING

BACKGROUND OF THE INVENTION

The present invention relates to a thermal spray powder and a thermal spray coating.

Hard chrome plating was often applied to surfaces of rolls such as corrugated rolls used in paper or film manufacturing lines. However, in recent years, tungsten carbide (WC)-based cermet thermal spray coatings have been used instead (see, for example, Japanese Laid-Open Patent Publication Nos. 8-60596 and 2006-29452).

A thermal spray coating generally has a high surface roughness. Thus, for use of a thermal spray coating in rolls, its surface roughness has to be reduced by polishing. In order to obtain a thermal spray coating with a low surface roughness for reducing the effort of polishing, it is known to be effective to use a thermal spray powder with a small particle size (see, for example, Japanese Laid-Open Patent Publication No. 2003-129212). However, a thermal spray coating formed from a thermal spray powder with a small particle size has an extremely lower wear resistance than that formed from a thermal spray powder with an ordinary particle size, and thus is not suitable for use in rolls.

SUMMARY OF THE INVENTION

Accordingly, an objective of the present invention is to provide a thermal spray powder suitable for the formation of a WC-based cermet thermal spray coating for use in a roll, and a thermal spray coating formed from the thermal spray powder.

In accordance with a first aspect of the present invention, a thermal spray powder including cermet particles is provided. Each of the thermal spray powder contains metal containing at least one selected from the group consisting of cobalt, chrome, and nickel, and tungsten carbide. The thermal spray powder has a ratio of 0.5 to 15% of the summed weight of cermet particles having a particle size of 25 μm or more with respect to the summed weight of the entire cermet particles.

In accordance with a second aspect of the present invention, a thermal spray coating is provided. The thermal spray coating is obtained by thermal spraying of the above thermal spray powder. The thermal spray coating has a center-line average surface roughness Ra of 3 μm or less. The thermal spray coating is regarded as a first thermal spray coating, and a second thermal spray coating is provided. The second thermal spray coating is different from the first thermal spray coating only in that the thermal spray powder for the second thermal spray coating has a particle size of 15 to 45 μm. The ratio of wear volume of the first thermal spray coating with respect to wear volume of the second thermal spray coating is 1.5 or less while the first and second thermal spray coatings are subjected to the same wear test.

Other aspects and advantages of the invention will become apparent from the following description, illustrating by way of example the principles of the invention.

DETAILED DESCRIPTION OF THE PREFERRED EMBODIMENTS

Hereinafter, one embodiment of the present invention will be described.

A thermal spray powder according to the present embodiment consists of cermet particles, each of which contains metal containing at least one selected from the group consisting of cobalt, chrome, and nickel, and tungsten carbide. The metal containing at least one selected from the group consisting of cobalt, chrome, and nickel may be a single substance of cobalt, chrome, or nickel, or an alloy containing at least one selected from the group consisting of cobalt, chrome, and nickel. From a viewpoint of enhancing the toughness of a thermal spray coating formed from the thermal spray powder, when the metal containing at least one selected from the group consisting of cobalt, chrome, and nickel contains chrome, the ratio of chrome in the metal is preferably 50% by mass or less.

It is essential that the thermal spray powder of this embodiment has a ratio of 0.5% or more of the summed weight of cermet particles having a particle size of 25 μm or more with respect to the summed weight of the entire cermet particles. As the ratio of the summed weight of cermet particles having a particle size of 25 μm or more in the thermal spray powder increases, an excellent peening effect can be obtained at the time of thermal spraying of the thermal spray powder, thus enhancing density and wear resistance of the thermal spray coating formed from the thermal spray powder. In this regard, when the ratio of the summed weight of cermet particles having a particle size of 25 μm or more is 0.5% or more, the peening effect at the time of thermal spraying of the thermal spray powder enables a thermal spray coating with excellent wear resistance suitable for use in rolls to be formed from the thermal spray powder. In order to increase the wear resistance of a thermal spray coating formed from the thermal spray powder to a particularly suitable level for practical use, the ratio of the summed weight of cermet particles having a particle size of 25 μm or more is preferably 1% or more, and more preferably 3% or more.

Further, it is essential that the thermal spray powder of this embodiment has a ratio of 15% or less of the summed weight of cermet particles having a particle size of 25 μm or more with respect to the summed weight of the entire cermet particles. As the ratio of the summed weight of cermet particles having a particle size of 25 μm or more in the thermal spray powder decreases, a thermal spray coating formed from the thermal spray powder has a low surface roughness. In this regard, when the ratio of the summed weight of cermet particles having a particle size of 25 μm or more is 15% or less, a thermal spray coating with a sufficiently low surface roughness usable for rolls can be formed from the thermal spray powder without polishing or with a little polishing. In order to reduce the surface roughness of a thermal spray coating formed from the thermal spray powder to a particularly suitable level for practical use, the ratio of the summed weight of cermet particles having a particle size of 25 μm or more is preferably 10% or less, and more preferably 5% or less.

The thermal spray powder of this embodiment preferably has a ratio of 0.5% or more of the summed volume of cermet particles having a particle size of 10 μm or less with respect to the summed volume of the entire cermet particles, more preferably 1% or more, and still more preferably 3% or more. As the ratio of the summed volume of cermet particles having a particle size of 10 μm or less in the thermal spray powder increases, the number of pores present in a thermal spray coating formed from the thermal spray powder decreases and the thermal spray coating has a low porosity. In other words, the thermal spray coating has an enhanced density and wear resistance. In this regard, when the ratio of the summed volume of cermet particles having a particle size of 10 μm or less is 0.5% or more, specifically 1% or more, and more specifically 3% or more, it is possible to enhance the wear resistance of a thermal spray coating formed from the thermal spray powder to a particularly suitable level for practical use.

Further, the thermal spray powder of this embodiment preferably has a ratio of 15% or less of the summed volume of cermet particles having a particle size of 10 μm or less with respect to the summed volume of the entire cermet particles, more preferably 12% or less, and still more preferably 10% or less. As the ratio of the summed volume of cermet particles having a particle size of 10 μm or less in the thermal spray powder decreases, the amount of fine particles contained in the thermal spray powder decreases, which may cause overmelting at the time of thermal spray of the thermal spray powder, thus unlikely to cause so-called spitting phenomenon at the time of thermal spraying. Spitting is a phenomenon wherein overmelted thermal spray powder adheres to and is deposited on an inner wall of a nozzle of a thermal spraying gun and the resultant deposits are dropped off from the inner wall at the time of thermal spray of the thermal spray powder thereby to be mixed with the thermal spray coating. When spitting occurs at the time of thermal spray of the thermal spray powder, the quality of a thermal spray coating formed from the thermal spray powder including wear resistance may be deteriorated. In this regard, when the ratio of the summed volume of cermet particles having a particle size of 10 μm or less is 15% or less, specifically 12% or less, and more specifically 10% or less, the occurrence of spitting can be reduced to a particularly suitable level for practical use.

The thermal spray powder of this embodiment preferably has a bulk specific gravity of 3.6 or more, more preferably 3.8 or more, and still more preferably 4.0 or more. As the bulk specific gravity of the thermal spray powder increases, an excellent peening effect can be obtained at the time of thermal spraying of the thermal spray powder, thus enhancing density and wear resistance of the thermal spray coating formed from the thermal spray powder. In this regard, when the bulk specific gravity of the thermal spray powder is 3.6 or more, specifically 3.8 or more, and more specifically 4.0 or more, peening effect at the time of thermal spraying of the thermal spray powder allows the wear resistance of a thermal spray coating formed from the thermal spray powder to be enhanced to a particularly suitable level for practical use.

Further, the thermal spray powder of this embodiment preferably has a bulk specific gravity of 6.0 or less. A decrease in bulk specific gravity of the thermal spray powder is less likely to cause insufficient softening or insufficient melting of the cermet particles at the time of thermal spraying, thus enhancing deposit efficiency (thermal spray yield) of the thermal spray powder. In this regard, when the bulk specific gravity of the thermal spray powder is 6.0 or less, the deposit efficiency of the thermal spray powder can be enhanced to a particularly suitable level for practical use.

The cermet particles of the thermal spray powder of this embodiment preferably have a crushing strength of 150 MPa or more, more preferably 200 MPa or more, and still more preferably 220 MPa or more. An increase in crushing strength of the cermet particles inhibits the disintegration of the cermet particles in the thermal spray powder, when the thermal spray powder exists in a tube connecting between a powder feeder and a thermal spraying gun while the thermal spray powder is fed from the feeder to the thermal spraying gun, or when the thermal spray powder fed to the thermal spraying gun is charged into a spraying flame. When the cermet particles are disintegrated, fine particles that may cause overmelting at the time of thermal spraying are produced in the thermal spray powder, thus easily causing the spitting at the time of thermal spraying of the thermal spray powder. In this regard, when the crushing strength of the cermet particles is 150 MPa or more, specifically 200 MPa or more, and more specifically 220 MPa or more, disintegration of the cermet particles can be substantially inhibited. As a result, the occurrence of spitting can be inhibited to a particularly suitable level for practical use.

Further, the cermet particles of the thermal spray powder of this embodiment preferably have a crushing strength of 800 MPa or less, more preferably 750 MPa or less, and still more preferably 700 MPa or less. A decrease in crushing strength of the cermet particles is less likely to cause insufficient softening or insufficient melting of the cermet particles at the time of thermal spraying, thus enhancing deposit efficiency (thermal spray yield) of the thermal spray powder. In this regard, when the crushing strength of the cermet particles is 800 MPa or less, specifically 750 MPa or less, and more specifically 700 MPa or less, the deposit efficiency of the thermal spray powder can be enhanced to a particularly suitable level for practical use.

The cermet particles of the thermal spray powder of this embodiment preferably contain tungsten carbide in an amount of 60% by mass or more, more preferably 70% by mass or more, and still more preferably 80% by mass or more. That is, the cermet particles contain metal in an amount of preferably 40% by mass or less, more preferably 30% by mass or less, and still more preferably 20% by mass or less. Tungsten carbide has better wear resistance than metal. Therefore, an increase in tungsten carbide content (that is, a decrease in metal content) enhances wear resistance of a thermal spray coating formed from the thermal spray powder. Further, tungsten carbide has a higher melting point than metal, and thus an increase in tungsten carbide content (that is, a decrease in metal content) is less likely to cause spitting at the time of thermal spraying of the thermal spray powder. In this regard, when the content of tungsten carbide in the cermet particles is 60% by mass or more, specifically 70% by mass or more, and more specifically 80% by mass or more, the wear resistance of a thermal spray coating can be enhanced to a particularly suitable level for practical use and the occurrence of spitting can be inhibited to a particularly suitable level for practical use. That is, when the metal content in the cermet particles is 40% by mass or less, specifically 30% by mass or less, and more specifically 20% by mass or less, the wear resistance of a thermal spray coating can be enhanced to a particularly suitable level for practical use and the occurrence of spitting can be inhibited to a particularly suitable level for practical use.

Further, the cermet particles of the thermal spray powder of this embodiment preferably contain tungsten carbide in an amount of 94% by mass or less, more preferably 92% by mass or less, and still more preferably 90% by mass or less. That is, the cermet particles contain metal in an amount of preferably 6% by mass or more, more preferably 8% by mass or more, and still more preferably 10% by mass or more. A decrease in tungsten carbide content (that is, an increase in metal content) is less likely to cause insufficient softening or insufficient melting of cermet particles at the time of thermal spraying, thus enhancing deposit efficiency of the thermal spray powder. In this regard, when the tungsten carbide content in the cermet particles is 94% by mass or less, specifically 92% by mass or less, and more specifically 90% by mass or less, the deposit efficiency of the thermal spray powder can be enhanced to a particularly suitable level for practical use. That is, when the metal content in the cermet particles is 6% by mass or more, specifically 8% by mass or more, and more specifically 10% by mass or more, the deposit efficiency of the thermal spray powder can be enhanced to a particularly suitable level for practical use.

The cermet particles of the thermal spray powder of this embodiment preferably have a circularity (aspect ratio) of 2 or less. As the circularity of the cermet particles becomes close to 1, the flowability of the thermal spray powder is enhanced. In this regard, if the circularity of cermet particles is 2 or less, the flowability of the thermal spray powder can be enhanced to a particularly suitable level for practical use.

The cermet particles of the thermal spray powder of this embodiment are preferably granulated and sintered particles. Granulated and sintered particles advantageously have a better flowability and less impurity incorporation during manufacture than melted and crushed particles and sintered and crushed particles. Granulated and sintered particles are prepared, for example, by granulating and sintering a raw material powder including a tungsten carbide powder and a metal powder that contains at least one selected from the group consisting of cobalt, chrome, and nickel. The resultant product is broken into smaller particles and, if necessary, is further classified. Melted and crushed particles are prepared by melting the raw material powder, cooling and solidifying the melted material, and crushing and, if necessary, classifying the resultant product. Sintered and crushed particles are prepared by sintering and crushing the raw material powder and, if necessary, classifying the resultant product.

When the cermet particles of the thermal spray powder of this embodiment are granulated and sintered particles, the primary particles of tungsten carbide forming the granulated and sintered particles preferably have an average particle size of 6 μm or less. A smaller average particle size of the primary particles of tungsten carbide is less likely to cause insufficient softening or insufficient melting of tungsten carbide in the cermet particles at the time of thermal spraying of the thermal spray powder, thus enhancing the deposit efficiency of the thermal spray powder. In this regard, when the average particle size of the primary particles of tungsten carbide is 6 μm or less, the deposit efficiency of the thermal spray powder can be enhanced to a particularly suitable level for practical use.

A thermal spray coating formed from the thermal spray powder of this embodiment preferably has a center-line average surface roughness Ra of 3 μm or less, more preferably 2.6 μm or less, and still more preferably 2.2 μm or less. when the center-line average surface roughness Ra of thermal spray coating is 3 μm or less, specifically 2.6 μm or less, and more specifically 2.2 μm or less, the thermal spray coating can be used for rolls without polishing or with a little polishing.

Supposing that a thermal spray coating formed from the thermal spray powder of this embodiment is regarded as a first thermal spray coating, a second thermal spray coating is prepared, which is different from the first thermal spray coating only in that the thermal spray powder used for the second thermal spray coating has a particle size of 15 to 45 μm (−45+15 μm). In this case, the ratio of wear volume of the first thermal spray coating with respect to wear volume of the second thermal spray coating is preferably 1.5 or less, more preferably 1.2 or less, and still more preferably 1.0 or less, while the first and second thermal spray coatings are subjected to the same wear test. when this ratio is 1.5 or less, specifically 1.2 or less, and more specifically 1.0 or less, a thermal spray coating formed from the thermal spray powder of this embodiment can be suitably used for rolls.

A thermal spray coating formed from the thermal spray powder of this embodiment preferably has a Vickers hardness of 1,000 or more. An increase in Vickers hardness of a thermal spray coating enhances wear resistance thereof. In this regard, when the Vickers hardness of a thermal spray coating is 1,000 or more, the wear resistance of the thermal spray coating can be enhanced to a particularly suitable level for practical use.

A thermal spray coating formed from the thermal spray powder of this embodiment preferably has a porosity of 2% or less. A decrease in porosity of a thermal spray coating reduces surface roughness thereof. Further, pits on the surface thereof are less likely to occur. In this regard, when the porosity of a thermal spray coating is 2% or less, the surface roughness thereof can be reduced to a particularly suitable level for practical use and the occurrence of pits can be inhibited to a particularly suitable level for practical use. The above porosity can be measured at a cross-section of a thermal spray coating after mirror polishing by an image analysis method.

The present embodiment provides the following advantage.

The thermal spray powder of this embodiment includes cermet particles, and each cermet particle contains metal containing at least one selected from the group consisting of cobalt, chrome, and nickel, and tungsten carbide. The thermal spray powder has a ratio of 0.5 to 15% of the summed weight of cermet particles having a particle size of 25 μm or more with respect to the summed weight of the entire cermet particles. Therefore, a thermal spray coating formed from the thermal spray powder of this embodiment has excellent wear resistance and low surface roughness, which is usable for rolls. That is, the thermal spray powder of this embodiment is suitable for the formation of WC-based cermet thermal spray coatings for use in rolls.

The above embodiment may be modified as follows.

The thermal spray powder may contain components other than cermet particles containing metal that contains at least one selected from the group consisting of cobalt, chrome, and nickel, and tungsten carbide. However, the content of components other than the cermet particles is preferably as little as possible.

The cermet particles of the thermal spray powder may contain components other than metal containing at least one selected from the group consisting of cobalt, chrome, and nickel, and tungsten carbide. Examples thereof include ceramic other than tungsten carbide, such as chromium carbide ($Cr_3C_2$) and titanium carbide (TiC). However, the content of components other than the metal and tungsten carbide is preferably as little as possible.

Next, the present invention is described in detail by referring to Examples and Comparative Examples.

As thermal spray powders of Examples 1 to 13 and Comparative Examples 1 to 4, prepared were granulated-sintered cermet particles consisting of a metal containing at least one selected from the group consisting of cobalt, chrome, and nickel, and a ceramic containing at least tungsten carbide. The detail of each thermal spray powder is shown in Table 1.

The column entitled "composition" in Table 1 shows the composition of cermet particles of each thermal spray powder.

The column entitled "$+D_{25\mu m}$" in Table 1 shows results obtained by measuring the ratio of the summed weight of cermet particles having a particle size of 25 μm or more to the summed weight of the entire cermet particles of each thermal spray powder. The measurement was performed using a low tap-type sieve shaking machine manufactured by Teraoka Corporation (see Japanese Industrial Standard ("JIS" for short) Z8801).

The column entitled "$-D_{10\mu m}$" in Table 1 shows results obtained by measuring the ratio of the summed volume of cermet particles having a particle size of 10 μm or less to the summed volume of the entire cermet particles of each thermal spray powder. The measurement was performed using a laser diffraction/dispersion type of particle size distribution measuring instrument "LA-300" manufactured by Horiba Ltd.

The column entitled "bulk specific gravity" in Table 1 shows results obtained by measuring the bulk specific gravity of each thermal spray powder. The measurement was performed in accordance with JIS Z2504.

The column entitled "crushing strength" in Table 1 shows results obtained by measuring crushing strength of cermet particles of each thermal spray powder. Specifically, the column shows a crushing strength σ [MPa] of particles in each thermal spray powder calculated in accordance with the equation: $\sigma=2.8\times L/\pi/d^2$. In the equation, L represents the critical load [N], and d represents the average particle size [mm] of thermal spray powder. The critical load is the magnitude of compressive load applied to particles at a point in time when the amount of displacement of an indenter is rapidly increased when the compressive load that increases at a constant rate is applied to the particles by the indenter. The critical load was measured using a micro compression tester "MCTE-500" manufactured by Shimadzu Corporation.

accordance with JIS H8682-1. The dry wear test was conducted using a Suga-type wear tester. In the test, polishing paper called CP180 in US CAMI (Coated Abrasives Manufacturers Institute) was used to friction the surface of thermal spray coating a designated number of times with a load of about 31 N (3.15 kgf). Based on the ratio, obtained by this wear test, of wear volume of the first thermal spray coating to wear volume of the second thermal spray coating, first thermal spray coatings formed from the thermal spray powders of Examples 1 to 13 and Comparative Examples 1 to 4 were evaluated in terms of wear resistance. Evaluation results are shown in the column entitled "wear resistance" in Table 1. In the column, "E" (excellent) indicates that the ratio is 1.0 or less; "G" (good) indicates that the ratio is greater than 1.0 and 1.3 or less; "F" (fair) indicates that the ratio is greater than 1.3 and 1.5 or less; and "P" (poor) indicates that the ratio is greater than 1.5.

TABLE 1

| | composition | $+D_{25\,\mu m}$ [%] | $-D_{10\,\mu m}$ [%] | bulk specific gravity | crushing strength [MPa] | average primary particle size of WC [μm] | Ra [μm] | wear resistance |
|---|---|---|---|---|---|---|---|---|
| Ex. 1 | Co 12%, WC remnant | 14.1 | 6.0 | 3.9 | 523 | 3.2 | G | E |
| Ex. 2 | Co 12%, WC remnant | 10.7 | 4.9 | 4.0 | 358 | 2.5 | G | E |
| Ex. 3 | Co 12%, WC remnant | 5.3 | 5.8 | 4.1 | 503 | 1.4 | G | E |
| Ex. 4 | Co 12%, WC remnant | 4.3 | 8.4 | 3.8 | 458 | 2.0 | E | E |
| Ex. 5 | Co 12%, WC remnant | 1.5 | 5.0 | 4.2 | 516 | 3.0 | E | G |
| Ex. 6 | Co 12%, WC remnant | 0.8 | 0.6 | 4.0 | 420 | 1.5 | E | G |
| Ex. 7 | Co 12%, WC remnant | 4.0 | 14.9 | 3.8 | 467 | 1.2 | E | F |
| Ex. 8 | Co 12%, WC remnant | 3.2 | 0.6 | 4.0 | 520 | 2.0 | F | E |
| Ex. 9 | Co 12%, WC remnant | 5.8 | 3.3 | 3.4 | 643 | 0.8 | E | F |
| Ex. 10 | Co 12%, WC remnant | 12.4 | 5.6 | 3.7 | 145 | 2.1 | G | F |
| Ex. 11 | Co 17%, WC remnant | 13.1 | 11.3 | 4.3 | 619 | 3.6 | G | E |
| Ex. 12 | $Cr_3C_2$ 20%, Ni 7%, WC remnant | 8.4 | 6.7 | 4.1 | 409 | 3.4 | G | E |
| Ex. 13 | Co 10%, Cr 4%, WC remnant | 4.1 | 2.0 | 4.3 | 387 | 2.9 | E | E |
| C. Ex. 1 | Co 12%, WC remnant | 62.9 | 0.4 | 4.8 | 385 | 1.8 | P | E |
| C. Ex. 2 | Co 12%, WC remnant | 16.3 | 5.2 | 4.5 | 416 | 1.5 | P | E |
| C. Ex. 3 | Co 12%, WC remnant | 0.1 | 14.2 | 3.7 | 440 | 1.2 | E | P |
| C. Ex. 4 | Co 12%, WC remnant | 0.0 | 97.0 | 2.5 | 538 | 1.5 | E | P |

The column entitled "average primary particle size of WC" in Table 1 shows results obtained by measuring the average particle size of the primary particles of tungsten carbide forming cermet particles of each thermal spray powder. The average particle size of the primary particles of tungsten carbide was measured by a Fisher method in accordance with JIS H2116.

Thermal spray coatings were formed by HVOF-spraying of the thermal spray powders of Examples 1 to 13 and Comparative Examples 1 to 4 under the conditions shown in Table 2. The obtained thermal spray coatings were evaluated in terms of the center-line average surface roughness Ra based on values measured under the conditions shown in Table 3. Evaluation results are shown in the column entitled "Ra" in Table 1. In the column, "E" (excellent) indicates that the obtained center-line average roughness value Ra was 2.2 μm or less; "C" (good) indicates that Ra was greater than 2.2 μm and 2.6 μm or less; "F" (fair) indicates that Ra was greater than 2.6 μm and 3.0 μm or less; and "P" (poor) indicates greater than 3.0 μm.

Thermal spray coatings (first thermal spray coatings) obtained by HVOF-spraying of the thermal spray powders of Examples 1 to 13 and Comparative Examples 1 to 4 under the conditions shown in Table 2, and other thermal spray coatings (second thermal spray coatings) that were different from the first thermal spray coating only in that thermal spray powder used for the second thermal spray coatings had a particle size of 15 to 45 μm, were subjected to the same dry wear test in

TABLE 2

Spraying gun: High-velocity flame spraying gun "JP-5000" manufactured by Praxait/TAFA
Oxygen flow rate: 1900 scfh (893 L/min)
Kerosene flow rate: 5.1 gph (0.32 L/min)
Spray distance: 380 mm
Banel length of spraying gun: 101.6 mm
Thermal spray powder feeding rate: 70 g/min

TABLE 3

Measurement instrument: "SURFCORDER SE-30H" manufactured by Kosaka Laboratory Ltd.
Cut-off wavelength λc: 0.8 mm
Standard length: 8 mm
Conveyance speed: 0.5 mm/sec As shown in Table 1, the thermal spray coatings of Examples 1 to 13 were fair, good, or excellent in the evaluation of any of center-line average roughness Ra and wear resistance. Thus, their results were satisfactory for practical use. In contrast, the thermal spray coatings of Comparative Examples 1 to 4 were poor in the evaluation of either of center-line average roughness Ra and wear resistance, and their results were not satisfactory for practical use.

The invention claimed is:

1. A thermal spray powder comprising cermet particles, each of which contains metal containing at least one selected from the group consisting of cobalt, chrome, and nickel, and tungsten carbide, wherein the thermal spray powder has a ratio of 0.5 to 15% of the summed weight of cermet particles having a particle size of 25 μm or more with respect to the summed weight of the entire cermet particles, and wherein the thermal spray powder has a ratio of 0.5 to 15% of the summed volume of cermet particles having a particle size of 10 μm or less with respect to the summed volume of the entire cermet particles.

2. The thermal spray powder according to claim 1, wherein the ratio of the summed weight of cermet particles having a particle size of 25 μm or more is 3 to 5%.

3. The thermal spray powder according to claim 1, wherein the ratio of the summed volume of cermet particles having a particle size of 10 μm or less is 3 to 10%.

4. The thermal spray powder according to claim 1, wherein the metal content in the cermet particles is 6 to 40% by mass, and the tungsten carbide content in the cermet particles is 60 to 94% by mass.

5. The thermal spray powder according to claim 4, wherein the metal content in the cermet particles is 10 to 20% by mass, and the tungsten carbide content in the cermet particles is 80 to 90% by mass.

6. The thermal spray powder according to claim 1, wherein the metal contains chrome and has a ratio of chrome of 50% by mass or less.

7. The thermal spray powder according to claim 1, wherein the thermal spray powder has a bulk specific gravity of 3.6 or more.

8. The thermal spray powder according to claim 7, wherein the bulk specific gravity of the thermal spray powder is 4 to 6.

9. The thermal spray powder according to claim 1, wherein the cermet particles have a crushing strength of 150 to 800 MPa.

10. The thermal spray powder according to claim 1, wherein the cermet particles have a circularity of 2 or less.

11. The thermal spray powder according to claim 1, wherein the cermet particles are granulated-sintered particles.

12. The thermal spray powder according to claim 1, wherein the ratio of the summed weight of cermet particles having a particle size of 25 μm or more is 1 to 10%.

13. The thermal spray powder according to claim 1, wherein the ratio of the summed volume of cermet particles having a particle size of 10 μm or less is 1 to 12%.

* * * * *